United States Patent [19]

Fermi et al.

[11] 4,191,106

[45] Mar. 4, 1980

[54] PRINTING PLATE CLAMPING ASSEMBLY

[75] Inventors: Rudy Fermi, South Bend; John Pickard, Elkhart; Alex Kocsis, Granger; David Bratton, Mishawaka, all of Ind.; Gerald Kasner, Union, Mich.

[73] Assignee: K and Manufacturing Company, Inc., Granger, Ind.

[21] Appl. No.: 636,454

[22] Filed: Dec. 1, 1975

[51] Int. Cl.[2] ..... B41F 27/12; B41F 27/14

[52] U.S. Cl. ..... 101/415.1; 101/378

[58] Field of Search ..... 101/415.1, 378

[56] References Cited

U.S. PATENT DOCUMENTS

| | | | |
|---|---|---|---|
| 3,019,729 | 2/1962 | Ringe et al. | 101/378 |
| 3,095,811 | 7/1963 | Peabody et al. | 101/415.1 |
| 3,103,169 | 9/1963 | Taylor | 101/415.1 |
| 3,425,348 | 2/1969 | Hemach et al. | 101/415.1 |
| 3,533,355 | 10/1970 | Wall | 101/415.1 |
| 3,603,255 | 9/1971 | Horner | 101/415.1 X |
| 3,626,848 | 12/1971 | Tafel | 101/415.1 |
| 3,646,886 | 3/1972 | Woessner et al. | 101/415.1 X |
| 3,696,744 | 10/1972 | Etchell | 101/415.1 |
| 3,702,098 | 11/1972 | Eburn, Jr. | 101/415.1 |
| 3,727,551 | 4/1973 | Kostas et al. | 101/415.1 |
| 3,750,572 | 8/1973 | Etchell et al. | 101/415.1 |
| 3,757,691 | 9/1973 | Etchell et al. | 101/415.1 |
| 3,766,857 | 10/1973 | Schlatter | 101/415.1 |
| 3,791,295 | 2/1974 | Albright | 101/415.1 |
| 3,805,701 | 4/1974 | Sonia | 101/415.1 |
| 3,824,928 | 7/1974 | Langer | 101/415.1 |
| 3,874,292 | 4/1975 | Parsley | 101/415.1 |
| 3,899,972 | 8/1975 | Albright | 101/415.1 |
| 3,913,480 | 10/1975 | Dauner et al. | 101/415.1 |
| 3,921,526 | 11/1975 | Cerny | 101/415.1 |
| 3,941,055 | 2/1976 | Semmler | 101/415.1 |

*Primary Examiner*—Louis G. Mancene
*Assistant Examiner*—Paul J. Hirsch
*Attorney, Agent, or Firm*—Craig and Antonelli

[57] ABSTRACT

Clamping apparatus is provided for holding thin flexible printing plates in position on a press cylinder. In some embodiments, shim members are attached to the outer periphery of the press cylinder for accurately radially positioning the printing plates with respect to the surface of the press cylinder. A clamping assembly is provided separately from and at a spacing from the shim members for releasably clamping one edge of the printing plate while the other edge of the printing plate is engaged over one of the edge portions of the shim member. The shim members and the clamping assembly are independently and separately attachable to the press cylinder so that the shim members can remain in position while printing plates are exchanged, as well as during removal and/or adjustment of the clamping assembly. A pair of symmetrically arranged lock bars are hingedly mounted for selective engagement with detent portions of the printing plates to accommodate reversal of the clamping direction. For very thin plastic plates the detent portions are formed as apertures engageable over pin sections of the lock bar and for other plates they are formed as bent back edge portions which engage over a smooth lock bar. The shim members are provided with symmetrical facing undercut smooth surfaces for anchoring the leading edge of the printing plate. The trailing edge of the printing plate is provided with a tool accommodating central recess. The leading edge of the printing plate is provided with centering apertures engageable with a retaining spring clip clamped in position on the press cylinder by a base member of the clamping assembly.

68 Claims, 23 Drawing Figures

PRINTING PLATE CLAMPING ASSEMBLY

BACKGROUND AND SUMMARY OF THE INVENTION

The present invention relates to a printing plate clamping assembly, and, more particularly, to apparatus for clamping flexible thin printing plates in position on a press cylinder. The present invention is primarily directed to an improved arrangement for clamping such thin flexible printing plates in position directly on the press cylinder and on shim members, which shim members are detachably attached to the press cylinder for radially positioning the printing plate with respect to the surface of the press cylinder. Such shim members are utilized in conjunction with existing presses made for earlier used very thick lead stereotype plates. In other words, the shim members serve to account for the difference in thickness between the thin flexible printing plate now generally used and the earlier lead stereotype plates.

New press cylinders dimensioned to fit the new thinner printing plates are substantially more expensive than are spacing members that can be added to existing narrower press cylinders. Therefore, many preferred embodiments of the present invention include shim members and printing plate clamping assemblies usable with such existing narrower press cylinders.

Other preferred embodiments of the present invention are usable with the press cylinders without spacing members. These embodiments include the novel clamping assembly of the present invention in conjunction with press cylinders that are grooved or cutout in accordance with the present invention to accommodate and assist such clamping apparatus. U.S. Pat. No. 3,702,098 to Eburn discloses a known apparatus for utilizing thin flexible printing plates on existing press cyliners. In Eburn specially constructed "saddle members" form the spacer members between the press cylinder surface and the thin printing plates. At the circumferential ends of these saddle members, a special clamping arrangement is provided for engaging and clampingly holding the thin plates on the surface of the saddle members for accommodating printing operations. Although this Eburn arrangement does accommodate for the difference in thickness of the previously used lead stereotype plates and the more practical modernday flexible thin plastic or metal-plastic plates, this arrangement still exhibits the following disadvantages:

1. Because of the required clamping apparatus mounted at the circumferential edge of the saddle member, significant portions of the structural material of the saddle member at such edge portions must be removed. Therefore, the edge portions of the saddle member are substantially weakened. Since the forces experienced in use in printing machines can be very great, especially in the event of a breakdown or paper wrap-up, these edge portions are subjected to frequent breakage, will consequent increased expenses for replacement of the saddler members, not to mention the increased downtime of the printing press to accommodate saddle member changes.

2. The construction of the saddle members, with the required special circumferential end portion cutouts and clamping assembly involves manufacturing complexities.

3. It is desirable to use the same printing machines, with the same press cylinders, for accommodating printing on different widths of paper. For example, due to ecology considerations as well as paper shortages, many newspapers and other publications have changed their page widths as well as column widths to economize on paper usage. With the Eburn arrangement having the clamping assembly built into the shim or saddle members, changes in printing web widths are practically impossible to accommodate without an exchange of saddle members. Web width changes with this arrangement necessarily involve not only the purchasing of different saddle member constructions, but also considerable printing press downtime for accommodating the changes.

4. In printing presses of the type contemplated by the present invention, particularly for accmmodating color printing, it becomes necessary to change the direction of rotation of a given press cylinder during use of the machines. Such change in direction of rotation of the press cylinder requires a reversal in the mounting direction of the thin printing plate. In arrangements such as Eburn, such press cylinder direction reversals generally require removal of the saddle and reversal of same, with respect to the press cylinder. These operations necessarily involve considerable time and expense.

5. In some prior arrangements such as in the Eburn patent, the thin flexible printing plates are placed in position on the saddle members remote from the press cylinder and the assembled configuration is then attached to the press cylinder. These operations require shutdown time for the printing press to accommodate changes, as well as additional personnel and space for accommodating the remote preassembly of the thin printing plates on the saddle members.

The Eburn patent is merely exemplary of various prior art attempts to solve the problem of utilizing the thin flexible printing plates on existing press cylinders. U.S. Pat. No. 3,696,744 to Etchell, U.S. Pat. No. 3,750,572 to Etchell et al., U.S. Pat. No. 3,874,292 to Parsley, and U.S. Pat. No. 3,805,701 to Sonia disclose additional saddle constructions, including clamping assemblies formed at the circumferential edge portions of the saddle members for accommodating attachment of the thin flexible printing plates. The constructions of these just-mentioned patents likewise exhibit substantially all of the above-noted disadvantages of the Eburn constructions. U.S. Pat. No. 3,766,857 to Schlatter also discloses a prior art arrangement requiring special printing saddle lock-up assembly and attachment mechanism at the circumferential edge of the saddle plate members, with the above-noted consequent disadvantages.

Other clamping arrangements for thin flexible printing plates have been disclosed for use with press cylinders, not necessarily requiring separate saddle members or shim means to accommodate for the radial position of the printing plate. However, these other prior arrangments, as exemplified by U.S. Pat. No. 3,552,314 to Skinner et al.; U.S. Pat. No. 3,608,487 to Luehrs; U.S. Pat. No. 3,757,691 to Etchell et al.; and U.S. Pat. No. 3,844,214 to Smith; all require special groove configurations and/or cutouts in the cylinder at the circumferential position of the flexible plate clamp, so that adaptation of these clamps to a saddle-type arrangement would also exhibit the various disadvantages delineated above. Further, these just-mentioned clamps exhibit disadvantages with respect to ease and cost of manufacture, as well as ease and reliability of operation, even when used as suggested on press cylinders without saddle members.

The present invention contemplates the provision of clamping apparatus which avoids the above-noted disadvantages of the prior art arrangements. According to one aspect of a first set of preferred embodiments of the present invention, there is provided a novel arrangement of a clamping assembly and shim members with the shim members being independently and separately attachable to the press cylinder from the clamping assembly. In this manner, the shim members can be constructed without the requirement for any cutouts or grooves to accommodate a clamping assembly, which would otherwise structurally weaken the edge portions thereof. Therefore, the shim members constructed according to the present invention are substantially stronger than the above-noted prior art arrangements with respect to resistance to breakage caused by the substantial build-up of pressure forces at the shim members during printing press malfunctions.

Since the shim members constructed in accordance with the present invention need no cutouts or grooves at the circumferentially facing edge portions, the cost and complexity of producing the shim members is substantially reduced. According to preferred embodiments of the present invention, a simple planar undercut surface at the edge portions of the shim members is provided for accommodating anchoring of the leading edge of the flexible printing plate.

With the clamping assembly per se being formed separately and being attached separately to the press cylinder from the shim members, it no longer becomes necessary to exchange and/or adjust the shim members themselves when changing the clamping assembly and/or adjusting the position of the same.

The present invention also contemplates the inclusion of registration and retaining spring clips with the clamping assembly so as to accurately axially position the leading edge of the printing plate, without requiring any special shim member construction for such purpose.

According to another aspect of the invention, both the shim members and the clamping assembly are constructed in a symmetrical manner so as to accommodate reversal of the circumferential direction of the printing plate without requiring any modifications to the shim member or clamping assembly construction. Since the shim members of preferred embodiments of the invention are constructed with simple planar undercut facing circumferential edge portions, a reversal in the direction of mounting of the thin printing plates is unaffected by the shim member construction.

In preferred embodiments of the invention, a symmetric clamping assembly including a pair of lock bars is provided, each of which lock bars is selectively engageable with the trailing edge of the printing plates to resiliently bias the same into an in-use clamped position. Since the clamping action for the lock bars of this preferred embodiment of the present invention involves only a continuously applied spring force in the clamping direction, exchange and/or reversal of direction of the flexible printing plates merely involves the movement of the respective lock bar to a position enabling engagement of the lock bar with detent means at the trailing edge of the plate, followed by a simple release of the pin bar to perform its clamping function.

In particularly preferred embodiments for use with printing plates having sufficient thickness to exhibit a predetermined rigidity, the detent means at the trailing edge of the plate is a simple smooth bent-over portion without recesses and extending beyond 180° so as to be clampingly engaged by a smooth lock bar.

In other preferred embodiments for use with very thin printing plates, especially pure plastic plates, having less than a predetermined rigidity, the detent means at the trailing edge of the plate includes recesses or apertures formed in a portion of the trailing edge, bent over by approximately 90°, which recesses are engaged by pin sections on a lock bar.

According to preferred embodiments of the present invention, the clamping assembly is so constructed as to facilitate removal and exchange of the thin flexible printing plates in a very rapid reliable manner, without requiring any disassembly of the shim members.

The above-mentioned provision of the clamping assembly being completely separate from the shim member construction facilitates changes in web widths of the flexible printing plates, without requiring any changes in the attachment of the shim members. According to another feature of preferred embodiments of the invention, the detent aperture configuration on the printing plates are selected so as to accommodate web width changes without necessarily requiring disassembly and adjustment of the clamping assembly.

In preferred embodiments of the invention, the clamping assembly is mounted so as to be adjustable to accommodate changes in thin flexible printing plates by simple and quick adjustments in the position of the clamping assembly on the press cylinder.

The present invention also contemplates embodiments with a plurality of short clamping assemblies arranged side by side so as to accommodate a multiple-part building block arrangement of the complete clamping assembly, whereby major changes with same can be readily and quickly made. Preferred embodiments of the present invention having the clamping assembly mounted directly to the press cylinder are advantageous in that the same can be very reliably and fixedly mounted at the relatively strong and rigid press cylinder, with the mounting connection thereof having no weakening effects on either the press cylinder or the shim member construction.

Most of the above-mentioned advantages of the clamping assembly of the present invention are also present in preferred embodiments where no shim members are present. In these embodiments, a gap is formed or cutout of the press cylinder to accommodate the clamping assembly. According to preferred embodiments of the present invention the edge portions which face one another to form the gap are formed symmetrically to accommodate simple reversal of the printing plate in a manner similar to the construction of the shim member edge portions discussed elsewhere herein.

Other important features of the present invention relate to the simple reliable compact constructional arrangement of the clamping assembly and the spring clip arrangement apparatus. In preferred embodiments, the clamping assembly is provided with a base member directly attachable to the press cylinder outer surface, which base member directly supports a hinge pin, or hinge pins in a two pin embodiment. The total vertical or radial height of this clamping assembly is maintained very small, while still maintaining the capability of providing high spring clamping forces on the lock bars holding the flexible printing plates in position. The axially extending hinge pins accommodate spiral springs therearound, which springs engage in a very simple manner against the lock bar member to bias the same in the clamping direction with high clamping forces. In the single hinge pin embodiments of the invention, one hinge pin economically accommodates a pair of symmetrically arranged lock bars, which are selectively in use depending upon the mounting circumferential direction of the printing plate.

Other preferred embodiments of the invention have two parallely extending hinge pins spaced from one another. In these embodiments, it is contemplated to accommodate the symmetrical optional reverse direction plate clamping arrangement in instances where the gap between the facing edge of the shim members is too great to accommodate the single pin arrangment. These embodiments are particularly useful for existing cylinder presses and arrangements exhibiting a wide gap between the facing ends of the shim members such as used by some newspapers.

By providing a unitary lock bar, as provided in particularly preferred embodiments, for engagement with the entire width of the flexible printing plate being clamped, it is possible in a simple manner to utilize the manual tool of the present invention to rotate the lock bar for simultaneous engagement of the lock bar along the width of the printing plate to automatically clamp the flexible plate in the assembled in-use position. Likewise, the manual tool can simultaneously disengage the lock bar to accommodate unclamping and removal of the printing plates.

The provision of the recess for the manual tool as spaced from the end of the shim members and press cylinder, preferably in the middle thereof, makes the same readily accessible for plate changes with the recess in the middle of the lock bar resulting in a uniform force when moved.

According to another feature of the invention, the lock bars in the single hinge pin embodiments are dimensioned such that by rotating the lock bars to the respective non-clamping position with the manual tool, ready access to adjustment screws for the axial position (in direction parallel to axis of rotation of the press cylinder) of the base member is obtained.

As also discussed above, the various embodiments of the present invention solve the prior art problems related to press cylinders that require spacer members to radially space the thin flexible printing plates, as well as the prior art problems of press cylinders which support thin flexible printing plates, without such spacer members.

These and further objects, features and advantages of the present invention will become more apparent from the following description, when taken in conjunction with the accompanying drawings and claims.

DETAILED DESCRIPTION OF THE DRAWINGS

Figure 1:
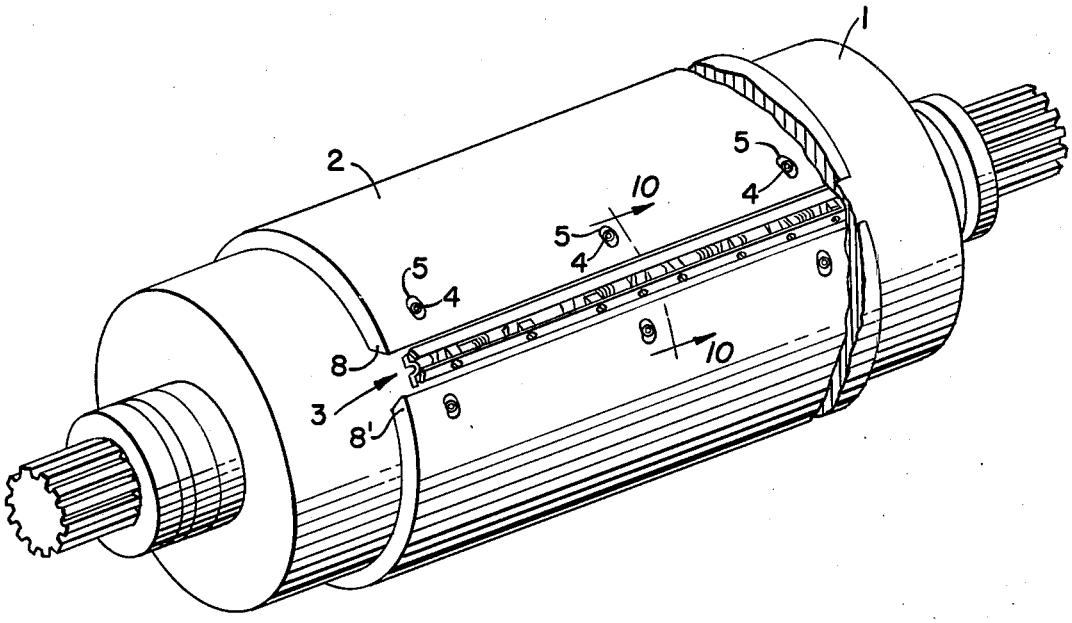
FIG. 1 is a perspective view depicting a press cylinder with a shim member and clamping assembly for flexible printing plates constructed in accordance with the present invention.

Throughout the drawing figures, like reference numerals are used to depict like structure.

The following description and the drawing figures refer primarily to embodiments with shim members formed separately of the press cylinder for radially spacing the printing plate with respect to the press cylinder surface. These embodiments are contemplated for use with press cylinders usually press cylinders originally made for thick lead stereotype plates, having a diameter too small to properly radially position the thin flexible printing plates. The other preferred embodiments of the invention for use with press cylinders which do not require or use shim members are the same in all respects except that the gap between the shim member ends, including the undercut portions to anchor the printing plates, is formed directly in the press cylinder as a cutout or groove section at the periphery of the press cylinder.

Figure 2:
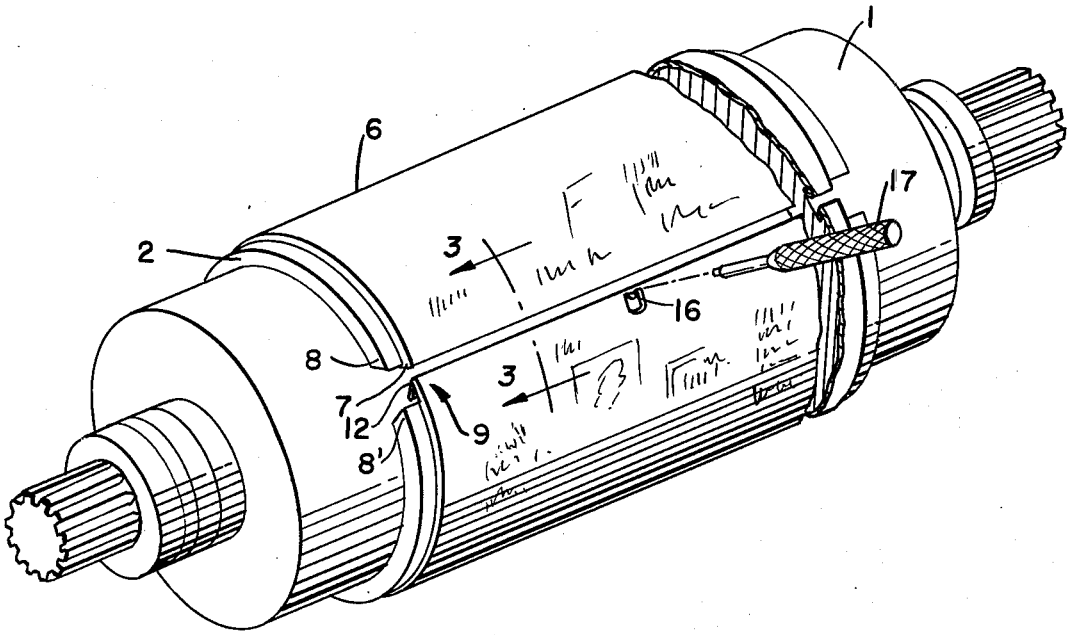
FIG. 2 is a perspective view similar to FIG. 1, which schematically depicts a flexible printing plate clamped in position, as well as a clamping tool according to the present invention for aiding in the clamping.

Referring to FIGS. 1 and 2, a printing press cylinder 1, of otherwise conventional construction, is provided with a shim member 2 and a clamping assembly 3 constructed according to an embodiment of the present invention. Shim member 2 extends circumferentially around the press cylinder 1 and is attached to said press cylinder 1 by threaded bolts 4 set in counter-sunk slotted apertures 5 in conjunction with clamping mechanisms (not shown as of conventional construction) of the type used for the old lead stereotype plates. Although only shim member 2 and clamping assembly 3 are shown in FIG. 1, it will be understood that the invention also contemplates provision of further sets of shim members and clamping assemblies along the axial length of the press cylinder 1 so as to accommodate the particular printing requirements.

FIG. 2 schematically depicts a flexible printing plate 6 clamped in an in-use printing position by the apparatus of the present invention. This printing plate 6 is to be constructed of a very thin plastic, or plastic coated metal material, and includes the printing impression on the outer circumferential surface thereof. Since, other than the particular aperture and bending arrangement for accommodating the clamping to the apparatus of the present invention, such flexible plates are of known construction, this description will only include details pertinent to the present invention. The printing plate 6 has a leading edge which is bent back upon itself to form a lip which engages with correspondingly configured edge portion 8 of the shim member 2. The opposite circumferential edge portion 8' of the shim member 2 is constructed in a symmetrical manner as is portion 8, for a purpose to be clearly explained below.

Figure 3:
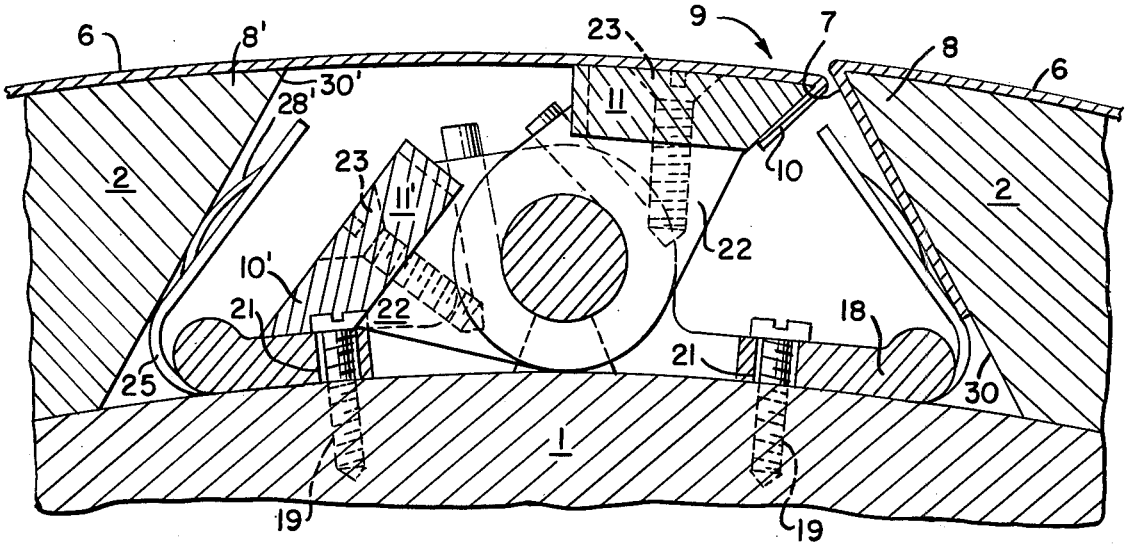
FIG. 3 is a partial cross-sectional view taken along line III—III of FIG. 2.
Figure 4:
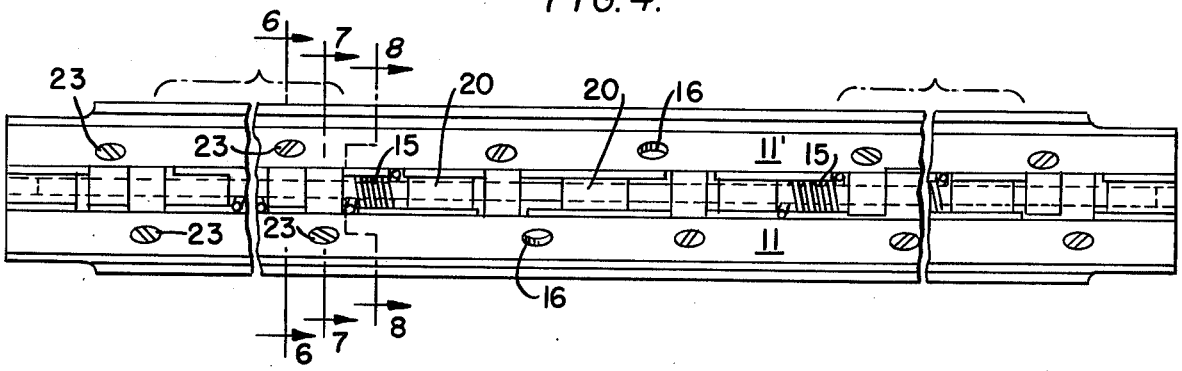
FIG. 4 is a partially broken enlarged top plan view, taken in the radial direction of the press cylinder and showing the clamping assembly of FIG. 1.
Figure 11:
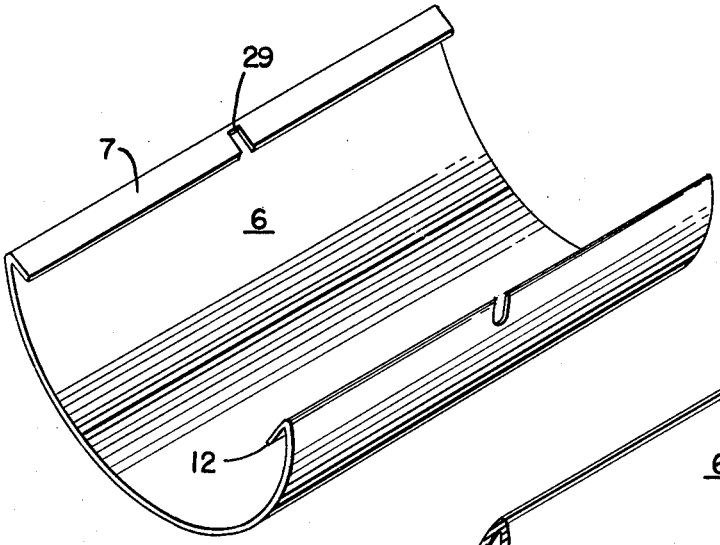
FIG. 11 is a schematic perspective view showing the bend and cutout configuration of the flexible printing plate construction of the present invention for use with the clamping apparatus of FIGS. 1–10.
Figure 12:
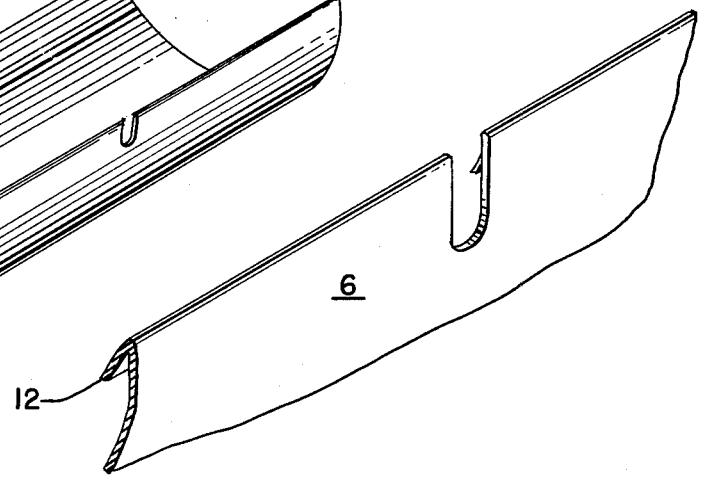
FIG. 12 is an enlarged partial view of the trailing edge of the flexible printing plate of FIG. 11.
Figure 16:
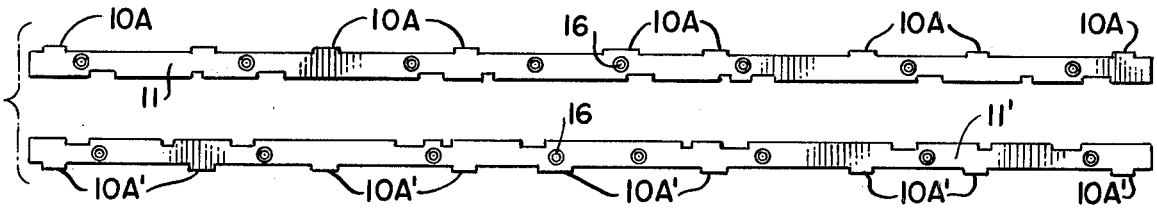
FIG. 16 is a plan view of another preferred embodiment of lock bars of the clamping assembly.
Figure 13:
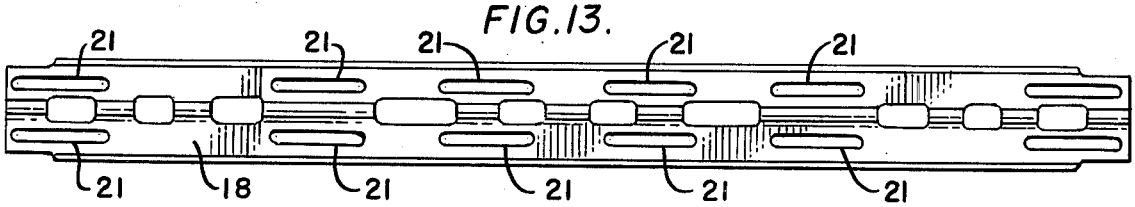
FIG. 13 is a bottom view of the base plate of the clamping assembly of FIGS. 1 to 10.

The trailing edge 9 of the printing plate 6 is clamping by engaged by edge portions 10 of lock bar 11 of the clamping assembly 3. As best illustrated in FIGS. 3, 11 and 12, trailing edge 9 of plate 6 includes a bent over portion 12 which engages over edge portion 10 when in the clamping position shown in FIG. 3. In the embodiment of FIGS. 1 to 10, a common hinge pin 14 privides a hinge axis for a pair of lock bars 11 and 11', which lock bars are symmetrically arranged for accommodating reverse orientation of the plate 6. In other words, the leading edge 7 of the plate 6 can be looped and anchord over edge portion 8' of shim member 2, in which case, edge portions 10' of bar 11' will engage at the trailing edge bent over portion 12 of the printing plate 6. When one of the lock bars 11, 11' is serving as a clamping bar, such as lock bar 11 in FIG. 3, the other lock bar 11' is in a rest position and also serves simultaneously as an abutment for spiral spring 15, which spiral spring applies a rotational continuous biasing force to the lock bar.

To accommodate unclamping and exchange of the plate 6, a recess 16 is provided at each of the lock bars 11, 11', which recess is adapted to matingly engage manually operable tool member 17 (FIGS. 2 and 8), whereby, with one hand, an operator can rotate the lock bar against the force of the spring 15 to a position accommodating release of the edge portions of the lock bar 11, 10 from the bent over portion 12 of the plate 6. On the other hand, when it is desired to clamp a plate 6 in position, one need merely insert the tool 17 into a recess 16, rotate the lock bar 11, 11' against the force of the spring and engage the edge portions 10 with the bent over portion 12, at which time release of the lock bar will automatically result in a tensioned clamping of the plate 6. As best shown in FIG. 3, there is ample space to permit the lock bar 11 to continuously resiliently pull circumferentially and downwardly on the trailing edge 9 of the plate 6.

A further feature of the present invention provides that the lock bars 11, 11', when a normal clamping position, are at a radial level of the press cylinder corresponding substantially to the facing edge portions 8, 8' of the shim member 2, whereby a substantially continuous surface of the printing plate 6, even across the gap between the edge portions 8, 8', results, without any radial outward protrusion of the clamping assembly or the plate 6 that could inhibit operation of the press.

Tool 17 includes a reduced diameter end portion insertable in aperture 16 and a shoulder portion of greater diameter which rests against the surface of the lock bars 11, 11' to limit the extent of penetration of the tool.

Figure 5:
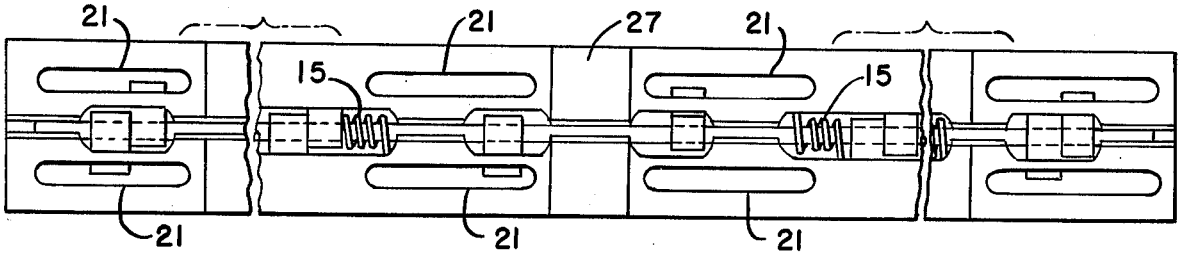
FIG. 5 is a bottom plan view of the clamping assembly depicted in FIG. 4.
Figure 6:
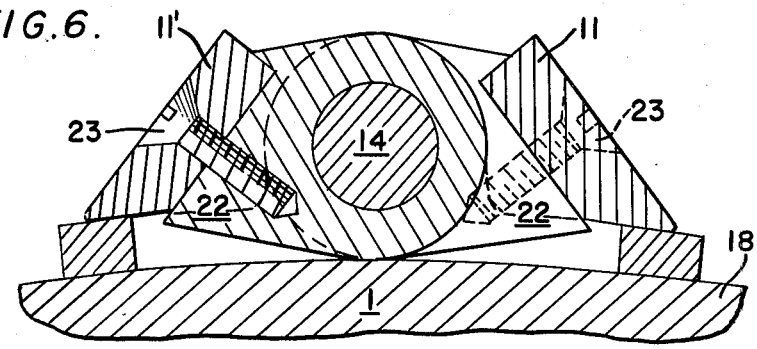
FIG. 6 is a cross-sectional view taken along the line VI–VI of FIG. 4.
Figure 7:
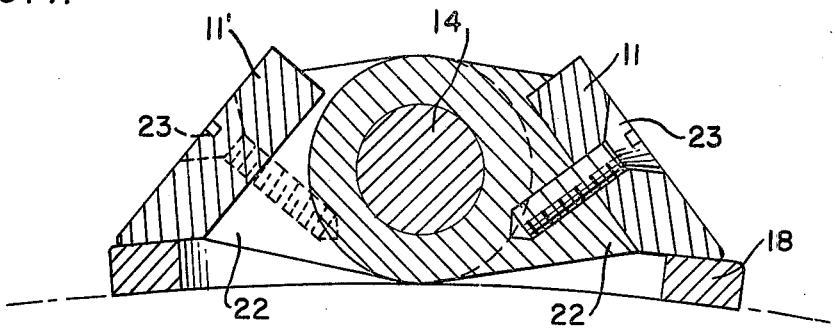
FIG. 7 is a cross-sectional view taken along line VII—VII of FIG. 4.
Figure 8:
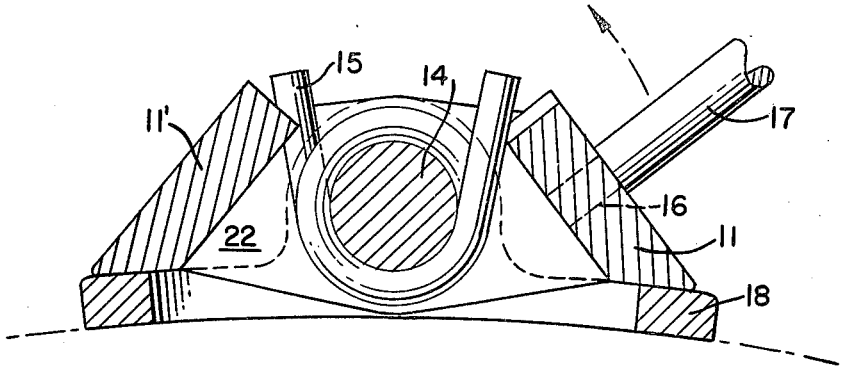
FIG. 8 is a cross-sectional view taken along line VIII—VIII of FIG. 4, and also including a partial showing of the tool for rotating the righthand lock bar.
Figure 9:
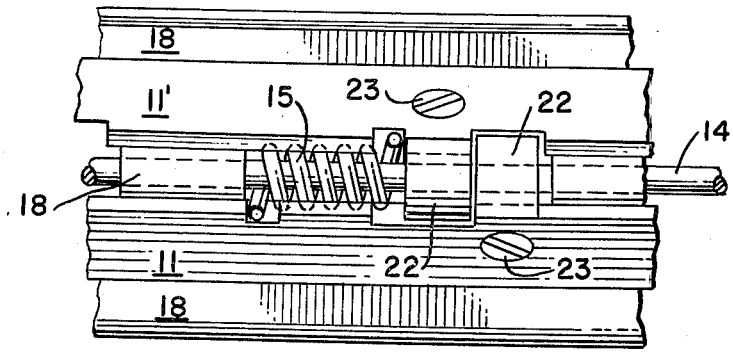
FIG. 9 is an enlarged partial top view of the clamping assembly of FIG. 4, depicting spring abutments at the lock bars.
Figure 10:
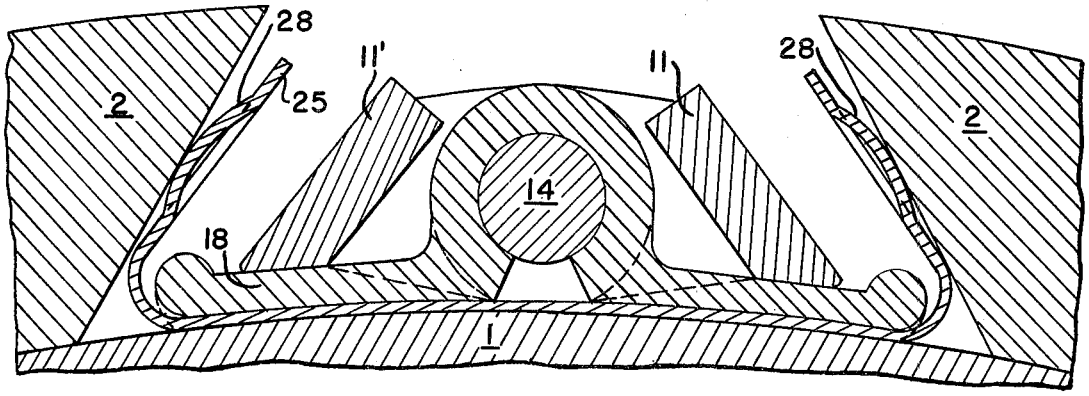
FIG. 10 is a partial-sectional view taken along line X—X of FIG. 1.

The hinge pin 14 is maintained in position by an integrally formed, preferably metal, hinge pin retainer bar base member 18. This base member 18 is detachably but rigidly attached to the press cylinder 1 by way of bolt member 19, as best shown in FIG. 3. This base member 18, includes portions 20 in partial surrounding and supporting engagement with hinge pin 14, and is interrupted with opening along its length for accommodating springs 15 surrounding the hinge pin 14. As best shown in FIG. 5, base member 18 includes slots 21, through which threaded fastening members 19 extend, which slots 21 accommodate longitudinal adjustment and positioning of the member 18 on the press cylinder. These slots 21 are spaced from one another at opposite sides of the hinge pin 14 such that, with the tool 17 engated and the respective lock bar 11 or 11' moved to its maximum non-clamping rotational position, one can insert a screwdriver or other unloosening tool for engagement with threaded members 19 to accommodate adjustment of the position of the base member 18, without the necessity of removing or moving the shim member 2.

The lock bars 11, 11' are attached to the hinge pin 14 by way of carrier lugs 22 and threaded members 23. These carrier lugs 22 are mounted at the hinge pin 14, by way of insertion of the hinge pin 14 through opening 24 extending axially through these carrier lugs 22. In the preferred illustrated embodiment of the invention, the hinge pin 14 is rotatably fixed by frictional engagement with the base member 18 and the lugs 22 are supported with sufficient clearance to accommodate rotation on the hinge pin 14.

In the specific illustrated embodiment of FIGS. 1 to 10, respective carrier lugs 22 for the lock bar 11 are spaced immediately adjacent carrier lugs 22 for the oppositely positioned lock bar 11', whereby the opened portions intermediate the bearing sections of member 18 for the pin 14 are optimally utilized. Also, according to the specifically illustrated preferred embodiment, the respective recesses or openings 16 for the lock bars 11 are provided symmetrically opposite one another at positions otherwise corresponding to mounting holes for the threaded members 23, with the lugs 22 adjacent said recesses 16 being not included, whereby manufacture of the lock bar and the mounting assembly for the same is advantageously simplified due to the uniformity along the length thereof.

Figure 14:
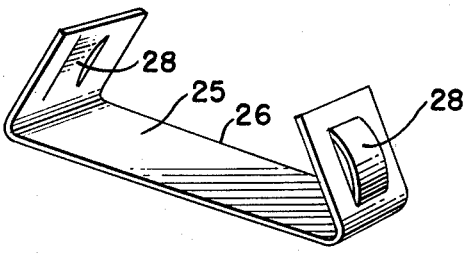
FIG. 14 is an enlarged schematic perspective view of a registration and retaining spring clip of the clamping assembly of FIGS. 1 to 10.
Figure 15:
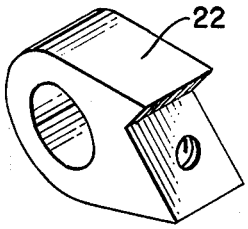
FIG. 15 is an enlarged perspective schemative view of a carrier lug for holding the lock bar of the clamping assembly of the present invention.
Figure 17:
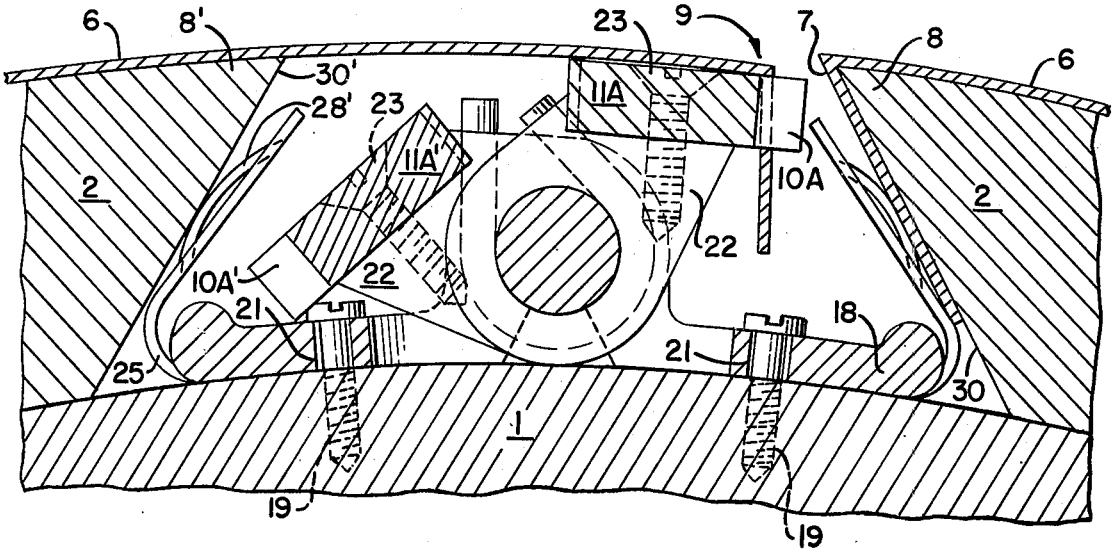
FIG. 17 is a partial cross-sectional view similar to FIG. 3 but showing a modified embodiment with lock bars as shown in FIG. 16, with pin sections for engagement in recesses at the trailing edge of the printing plate.
Figure 18:
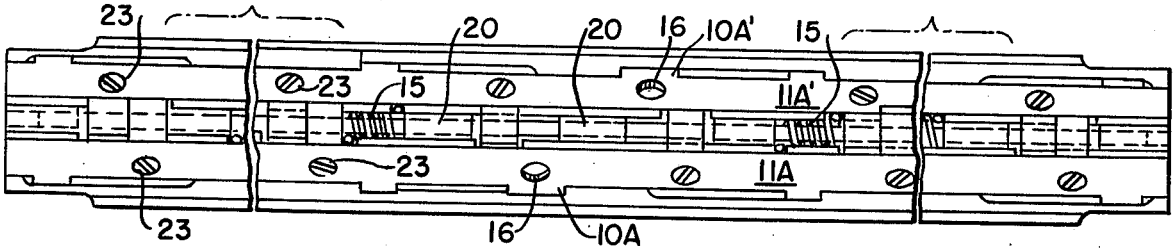
FIG. 18 is a partially broken enlarged top plan view, similar to FIG. 4, but showing the modified embodiment of FIGS. 16 and 17.
Figure 19:
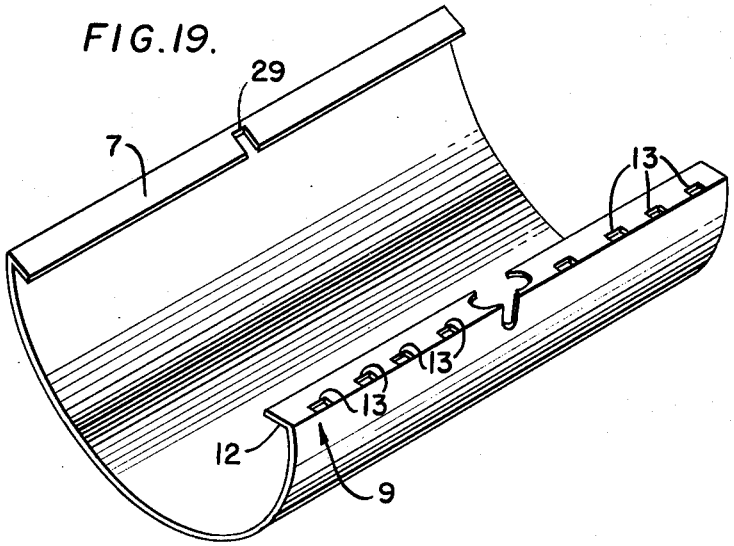
FIG. 19 is a schematic perspective view showing the bend and cutout configuration of the printing plate for use with the clamping apparatus of FIGS. 16–18.

To accommodate registration an alignment of the leading edge 7 of the printing plate 6, registration and retaining spring clips 25 are provided. As best shown in FIGS. 3 and 14, each of these retaining clips 25 include a base portion 26 which extends underneath base member 18 along grooves 27, which maintain the same in fixed axial positions along the base member 18. Each spring clip 25 also includes protruding bulge portions 28, 28', for aligning engagement with an opening or openings 29 on the leading edge 7 of the flexible printing plate 6. When raised or bulge portion 28 is alignigly engaged in opening 29 of the flexible printing plate 6, the oppositely arranged bulge portion 28' is engaged against the smooth planar surface 30' of the respective opposite edge portion 8' of the shim member 2. Each of these spring clips 25 are configured so as to be spring biased against the respective planar surfaces 30, 30' of the shim member 2, when clamped in position by the base member 18.

Although the attachment and detachment of a printing plate 6 to the above described apparatus of FIGS. 1 to 10 should be readily apparent from the above description, following is a summary of said operations. When it is desired to assemble a printing plate 6 onto the assembly, one merely slips the leading edge 7 of plate 6 over the edge portion 8 of shim 2. While slipping this leading edge into position, one need only approximately align bulge portion 28 of spring clip 25 with cutout portion 29, and then slide the plate 6 slightly in the lateral or axial direction of the press cyliner until spring snap engagement of bulge portion 28 with cutout 29. Once the leading edge is positioned as described, one merely need rotate the press cylinder while holding the outer circumference of the press plate against the outer circumference of the shim member 2 to bring the trailing edge 9 adjacent the clamping assembly. One then can, with one hand holding the plate 6 in position on the shim member 2, insert tool 17 in recess 16, move lock bar 11 in the counterclockwise direction as viewed in FIG. 3, slip the bent over portion 12 of the trailing edge 9 over the lock bar 11 so that edge portions 10 engage said portions 12, and then slowly permit rotation of the lock bar 11 into the locking position shown in FIG. 3, at which time the pin 17 can be removed, the spring 15 in conjunction with the lock bar 11 effecting an automatic continuous tensioning holding of the printing plate 6 in position. For disassembly, one need merely reverse the above operation. In view of the symmetrical arrangement of the clamping apparatus and the edge portions 8 and 8' of the shim member 2, the apparatus of the present invention lends itself to attachment of the printing plate so as to extend in either circumferential direction, without any modifications needed to the shim member and/or clamping structure.

Further, since the surface portions 30 and 30' are smooth, and correspond to the shape of the bent back portion of the leading edge of the printing plate 6, the same width shim member 2 can be utilized for a variety of different width printing plates, so long as the clamping apparatus is configured to engage the respective openings 29 on the printing plate.

FIGS. 16–19 depict a second preferred embodiment of the present invention. Like reference numerals are used in these figures as in FIGS. 1–10 for substantially identical structure. The only structure of this embodiment that differs from that of the embodiment of FIGS. 1 to 10 is the construction of the lock bars 11A, 11A' and the construction of the trailing edge portion 9A of the plate 6A to accommodate said lock bars 11A, 11A'. Lock bars 11A, 11A' differ from lock bars 11, 11' in that pin sections 10A, 10A' are provided in place of smooth edge sections 10, 10' for engagement with the apertures 13 in the trailing edge 9A of the plate 6A. Edge 9A also has a different bend portion 12A which extends substantially radially of the press cylinder to orient the apertures 13 generally in the circumferential direction of the press cylinder. The clamping and unclamping of the printing plate for this embodiment of FIGS. 16 to 19 is substantially as described above for the embodiment of FIGS. 1 to 10 except that the pin sections 10A, 10A' are engaged in and protrude through apertures 13A while in the other embodiment edge sections 12 mate with and engage correspondingly configured sections 10 of the smooth lock bar without any pins protruding thrugh the plate. This embodiment of FIGS. 16 to 19 is particularly useful for very thin printing plates which have insufficient rigidity to be adequately supported by the smooth bar and bent back plate portions of the embodiment of FIGS. 1 to 10.

Figure 20:
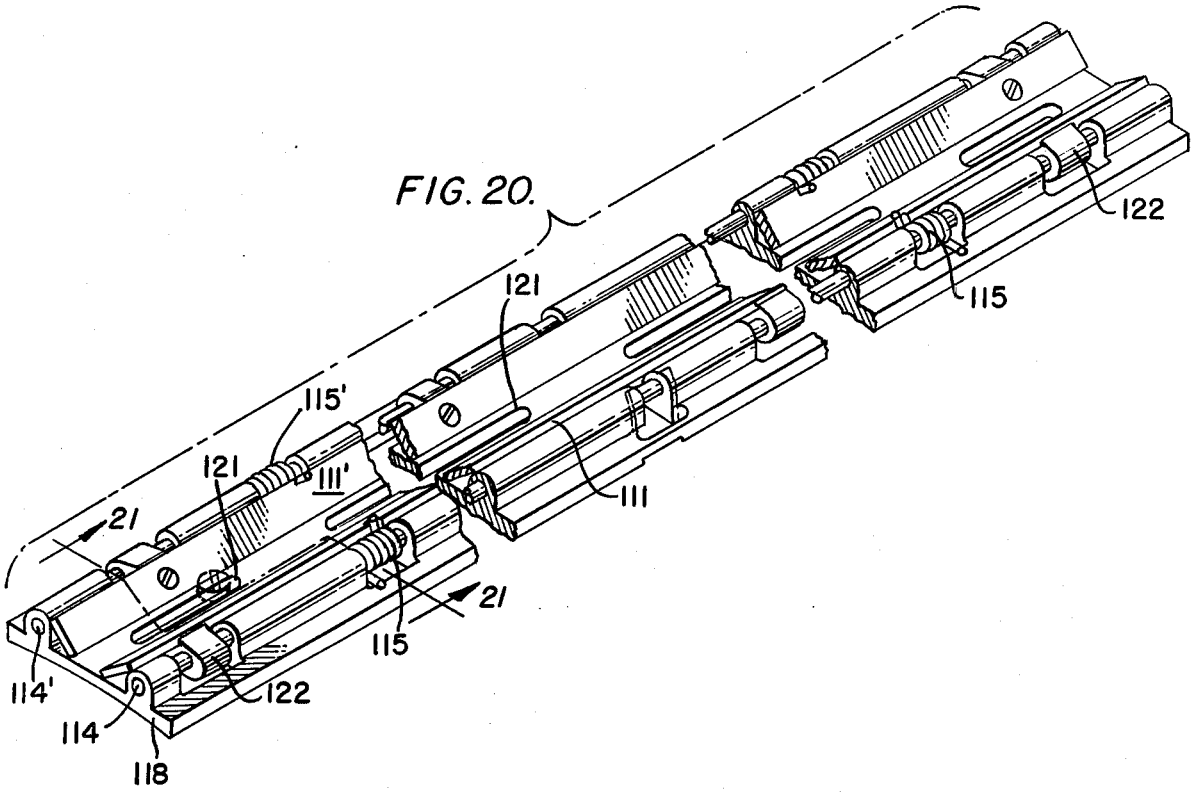
FIG. 20 is a partially broken enlarged perspective top view of a further embodiment of a clamping assembly constructed in accordance with the present invention.
Figure 21:
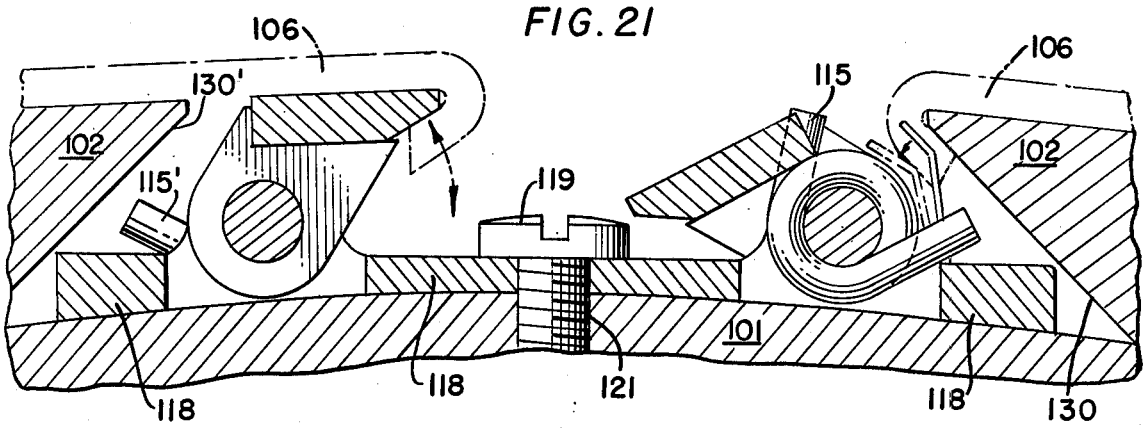
FIG. 21 is a cross-sectional view taken along line XXI—XXI of FIG. 20.
Figure 22:
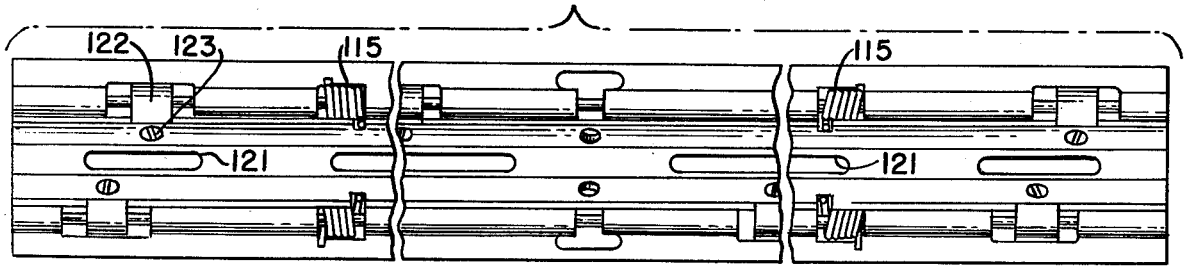
FIG. 22 is a top view of the clamping assembly of FIG. 20.

FIGS. 20 to 22 depict a third preferred embodiment of the present invention. Similar reference numerals, raised in magnitude by 100, are used in these figures to designate correspondingly functioning structure as in the embodiment of FIGS. 1 to 10. The embodiment of FIGS. 20 to 22 differs from the embodiment of FIGS. 1 to 10 in that, rather than providing a single hinge pin 14, a pair of hinge pins 114 and 114' are provided for supporting the respective lock bars 111, 111'. In this manner, it is possible to retain a low vertical, or radial as viewed with respect to the axis of rotation of press cylinder 1, dimension of the clamping assembly, while accommodating usage in a wide gap between the edge portions 108, 108' of the shim member 102. In other respects, the construction and operation of the embodiment of FIGS. 20 to 22 to corresponds to that of the embodiment of FIGS. 1 to 10.

To accommodate support of the pair of hinge pins 114, 114', the base member 118 includes two sets of raised bearing supports for the hinge pins, and a centrally located set of slots 121 and attachment members 119 for attaching the base member 118 in an adjustable manner to the press cylinder 101. The spring members 115 and 115', rather than utilizing the other of the lock bars for a stop as in the FIGs. 1 to 10 embodiment, are stopped by engagement with the base member 118 at their ends.

A further preferred embodiment is similar to the embodiment of FIGS. 20 to 22 with respect to the pair of spaced hinge pins. However this further preferred embodiment uses lock bars similar to those of the embodiment of FIGS. 16 to 19, with corresponding configuration of the trailing edge of the printing plate with recesses to accommodate pin sections of the lock bar protruding therethrough.

Figure 23:
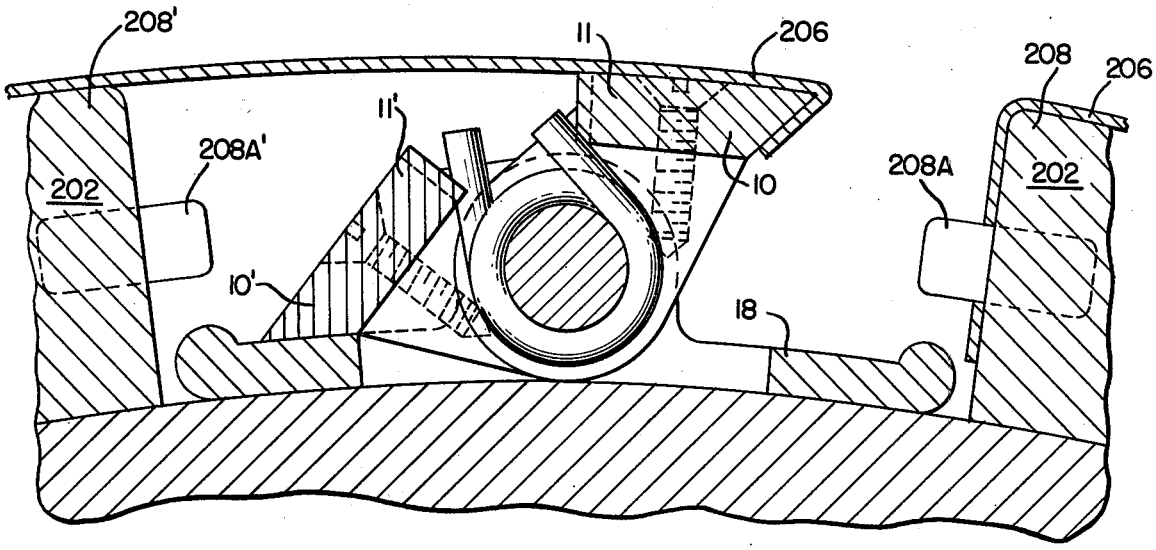
FIG. 23 is a schematic part sectional view of another embodiment of the invention.

FIG. 23 illustrates another preferred embodiment which differs from the other preferred embodiments in the construction of the edge portions 208, 208' of the shim members 202. Rigid pin members 208A, 208A' are provide for engaging apertures provided at the leading edge, bent at 90°, of the printing plate 206. This FIG. 23 configuration of the shim members 202 is especially advantageous for clamping very weak and thin plates, sich as DiLitho plates, which plates have insufficient strength for self support by only their bent back portions as in the other embodiments shown. One or more of said pin members 208A, 208A' are provided across the width of the shim members 202 to aid in holding the leading edge of the plates 206.

As pointed out at the outset of this detailed description, the illustrated preferred embodiments of the present invention relate specifically to constructions wherein detachable shim members 2 are attached to a press cylinder 1 to radially space the thin flexible plate members so as to accommodate press cylinders originally constructed for use with thicker lead stereotype plates. However, preferred embodiments are also contemplated by the present invention with integrally formed press cylinders having a cutout groove or formed groove portion similar to the space or gap between the circumference of the press cylinder 1 and the edge portions 8, 8' of the shim member described above. Such last-mentioned preferred embodiments are similar in all other respects to the above-described embodiments.

While we have shown and described only several embodiments in accordance with the present invention, it is understood that the same is not limited thereto but is susceptible of numerous changes and modifications as would be known to those skilled in the art, given the present disclosure, and we therefore do not wish to be limited to the details shown and described herein but intend to cover all such changes and modifications as are encompassed by the scope of the appended claims.

We claim:

1. Apparatus for detachably holding thin flexible printing plates in position on a cylindrically shaped press cylinder comprising:

shim means configured to accurately radially position a printing plate with respect to the cylindrical outwardly facing surface of the press cylinder, shim attaching means for attaching said shim means to the press cylinder with respective oppositely circumferentially facing shim edge portions being spaced from one another to form a gap there between, a clamping assembly for releasably clamping a first plate edge portion of said printing plate to said press cylinder with said printing plate engaged against an outwardly facing plate supporting surface of said shim means, and clamping assembly attaching means for detachably attaching said clamping assembly to said press cylinder, said clamping assembly attaching means being separate from said shim attaching means, said shim means and clamping assembly being dimensioned and configured such that said clamping assembly fits within said gap without protruding radially outwardly beyond the radial outward extent of said shim means when in an operating position clamped to said press cylinder, wherein said clamping assembly includes a base member, and wherein said clamping assembly attaching means includes means for fixedly holding said base member directly against said outwardly facing surface of the press cylinder.

2. Apparatus according to claim 1, wherein a first of said shim edge portions is interengageable with a second plate edge portion of said printing plate to anchor the second plate edge portion when said printing plate is clamped in position with said clamping assembly engaged with said first plate edge portion.

3. Apparatus according to claim 2, wherein said clamping assembly includes a pair of clamping members which are symmetrically constructed to selectively clamp said first plate edge with said printing plate extending in respective opposite circumferential directions of said press cylinder, and wherein said shim edge portions are symmetrically constructed to anchor said second plate edge with said printing plate extending in respective opposite circumferential directions of said press cylinder, whereby the circumferential direction of the printing plate can be readily reversed to accommodate reversal of the direction of rotation of the press cylinder without requiring removal of either the shim means or the clamping assembly from the press cylinder.

4. Apparatus according to claim 2, wherein said shim edge portions are uninterrupted by circumferentially extending notches, whereby changes in web width of the printing plate can be accommodated without requiring removal or adjustment of said shim means.

5. Apparatus according to claim 2, wherein said clamping assembly includes alignment clip means engageable with detent means of said second plate edge portin for aligning said second plate edge portion in the direction parallel to the rotational axis of the press cylinder.

6. Apparatus according to claim 5, wherein said alignment clip means is a spring clip member formed separately of said shim means, and wherein said clamping assembly includes a base member which clamps said spring clip member against said press cylinder when in the operating position.

7. Apparatus according to claim 1, wherein said clamping assembly includes a clamping member movably supported at said base member, said clamping member being engageable directly with said first plate edge portion when in a clamped position.

8. Apparatus according to claim 7, wherein said clamping assembly attaching means includes threaded means for clamping said base member against said press cylinder.

9. Apparatus according to claim 8, wherein said clamping assembly includes alignment clip means engageable with detent means of said second plate edge portion for aligning said second plate edge portion in the direction parallel to the rotational axis of the press cylinder, and wherein said alignment clip means is clampingly held in position against said press cylinder by said base member.

10. Apparatus according to claim 1, wherein said clamping assembly includes:

hinge pin means supported at said base member, clamp member means attached to said hinge pin means for pivotal movement about a hinge pin axis between a clamping position with said clamp member means clampingly engaged in plate detent means of said first plate edge portion and a non-clamping position out of engagement with said plate detent means, and resilient means for continuously resiliently rotationally biasing said clamp member means toward said clamping position.

11. Apparatus according to claim 10, wherein said clamp member means includes a smooth lock bar, and wherein said plate detent means is a smooth bent back end portion partially surroundingly engageable with said smooth lock bar.

12. Apparatus according to claim 10, wherein said clamp member means includes a pin lock bar having a plurality of protruding pin sections, and wherein said plate detent means includes a plurality of recesses in said plate for accommodating protrusions of said pin sections therethrough.

13. Apparatus according to claim 10, further comprising tool means selectively engageable in recess means of said clamp member means for forcibly moving said clamp member means toward said non-clamping position to accommodate engagement of said plate detent means with said clamp member means.

14. Apparatus according to claim 13, wherein said recess means extends substantially radially of said press cylinder when said clamping assembly is in an in-use position, and wherein said recess means is disposed intermediate the axial ends of said clamp member means.

15. Apparatus according to claim 14, wherein said recess means is disposed axially in the middle of said clamp member means.

16. Apparatus according to claim 15, wherein said clamp member means includes a single rigid member which extends substantially across the entire width of a printing plate being clamped thereby.

17. Apparatus according to claim 10, wherein said clamping assembly includes alignment clip means engageable with detent means of said second plate edge for aligning said second plate edge in the direction parallel to the rotational axis of the press cylinder.

18. Apparatus according to claim 17, wherein said alignment clip means is clamped between said base member and the circumference of said press cylinder.

19. Apparatus according to claim 18, wherein said alignment clip means includes respective opposite ends resiliently engaged against the respective facing edge portions of the shim means.

20. Apparatus according to claim 18, wherein said base member includes groove means at the bottom thereof for guidably positioning said alignment clip means.

21. Apparatus according to claim 10, wherein said clamp member means includes a flat metal bar having protrusions thereon for engaging in said plate detent means.

22. Apparatus according to claim 10, wherein said clamping assembly attaching means includes threaded members insertable through slots in said base member, said slots being longer than the diameter of said threaded member to accommodate adjustment of the position of said base member on said press cylinder.

23. Apparatus according to claim 10, wherein said clamping assembly includes:

bearing means separate from said base member and said hinge pin means for attaching said clamp member means to said hinge pin means, and spiral spring means surrounding said hinge pin means and bearing against said clamp member means.

24. Apparatus according to claim 1, wherein said shim edge portions are configured as smooth undercut edges uninterrupted along the length thereof in a direction parallel to the axis of said press cylinder.

25. Apparatus according to claim 1, wherein said clamping assembly attaching means includes threaded bolt means for fixedly holding said base member directly against said outwardly facing surface of the press cylinder.

26. Apparatus according to claim 25, wherein said shim attaching means include threaded bolt means for fixedly holding said shim means directly against said outwardly facing surface of the press cylinder.

27. Apparatus according to claim 1, wherein said shim attaching means include theaded bolt means for fixedly holding said shim means directly against said outwardly facing surface of the press cylinder.

28. Apparatus according to claim 1, wherein said clamping assembly is disposed at a spacing from the respective oppositely circumferentially facing shim edge portions wherein said operating position.

29. Apparatus according to claim 1, wherein said clamping assembly includes:

hinge pin means carried by said base member, clamp member means pivotally movable about said hinge pin means, said clamp member means being directly engageable with said first plate edge portion when in a clamping position, resilient means for resiliently biasing said clamp member means toward its clamping position, tool means selectively engageable in recess means of said clamp member means for forcibly moving said clamp member means toward a non-clamping position to accommodate engagement of said plate detent means with said clamp member means, and aperture means in said base member for accommodating insertion of bolts therethrough to clamp said base member to the surface of said press cylinder, said bolts forming at least part of said clamping assembly attaching means, wherein said clamp member means and said aperture means are disposed such that said clamp member means covers said apertures in the radial outward direction when in a clamping position, and wherein said apertures are uncovered in the radial direction when said clamp member means is in an unclamping position, whereby attaching and detaching of said clamping assembly can be accommodated by movement of said clamp member means to the non-clamping position thereof.

30. Apparatus for detachably holding thin flexible printing plates in position on a cylindrically shaped press cylinder comprising:

shim means configured to accurately radially position a printing plate with respect to the cylindrical outwardly facing surface of the press cylinder, shim attaching means for attaching said shim means to the press cylinder with respective oppositely circumferentially facing shim edge portions being spaced from one another to form a gap there between, a clamping assembly for releasably clamping a first plate edge portion of said printing plate to said press cylinder with said printing plate engaged against an outwardly facing plate supporting surface of said shim means, and clamping assembly attaching means for detachably attaching said clamping assembly to said press cylinder, said clamping assembly attaching means being separate from said shim attaching means, said shim means and clamping assembly being dimensioned and configured such that said clamping assembly fits within said gap without protruding radially outwardly beyond the radial outward extent of said shim means when in an operating position clamped to said press cylinder, wherein said clamping assembly includes:

a base member detachably attachable to said press cylinder means, hinge pin means supported at said base member, clamp member means attached to said hinge pin means for pivotal movement about a hinge pin axis between a clamping position with said clamp member means clampingly engaged in plate detent means of said first plate edge portion and a non-clamping position out of engagement with said plate detent means, and resilient means for continuously resiliently rotationally biasing said clamp member means towards said clamping position, and wherein said hinge pin means is constructed as a single hinge pin for supporting two clamp member means which are clampingly pivotal in respective opposite directions to facilitate reversal of the circumferential direction of the printing plate being clamped.

31. Apparatus according to claim 30, wherein a single set of spiral spring means is disposed around said hinge pin for resiliently biasing both of said clamp member means towards their respective clamping positions.

32. Apparatus for detachably holding thin flexible printing plates in position on a cylindrically shaped press cylinder comprising:

shim means configured to accurately radially position a printing plate with respect to the cylindrical outwardly facing surface of the press cylinder, shim attaching means for attaching said shim means to the press cylinder with respective oppositely circumferentially facing shim edge portions being spaced from one another to form a gap there between, a clamping assembly for releasably clamping a first plate edge portion of said printing plate to said press cylinder with said printing plate engaged against an outwardly facing plate supporting surface of said shim means, and clamping assembly attaching means for detachably attaching said clamping assembly to said press cylinder, said clamping assembly attaching means being separate from said shim attaching means, said shim means and clamping assembly being dimensioned and configured such that said clamping assembly fits within said gap without protruding radially outwardly beyond the radial outward extent of said shim means when in an operating position clamped to said press cylinder, wherein said clamping assembly includes:

a base member detachably attachable to said press cylinder means, hinge pin means supported at said base member, clamp member means attached to said hinge pin means for pivotal movement about a hinge pin axis between a clamping position with said clamp member means clampingly engaged in plate detent means of said first plate edge portion and a non-clamping position out of engagement with said plate detent means, and resilient means for continuously resiliently rotationally biasing said clamp member means towards said clamping position, and wherein said hinge pin means is constructed as a pair of parallel hinge pins for supporting respective separate clamp member means which are clampingly pivotal in respective opposite direction to facilitate reversal of the circumferential directions of the printing plate being clamped.

33. Apparatus for releasably clamping a plate edge portion of a thin flexible printing plate to press cylinder means with said printing plate supported in an in-use printing position on a circumferential surface of said press cylinder means; said apparatus including:

a base member attachable to a radially outwardly facing surface of a press cylinder, hinge pin means supported at said base member, clamp member means attached to said hinge pin means for pivotal movement about a hinge pin axis between a clamping position with said clamp member means clampingly engaged in plate detent means of said plate edge portion and a non-clamping position out of engagement with said plate detent means, and resilient means for continuously resiliently rotationally biasing said clamp member means toward said clamping position wherein said hinge pin means is constructed as a single hinge pin for supporting two clamp members which are clampingly pivotal in respective opposite directions to facilitate reversal of the circumferential direction of the printing plate being clamped, said clamp members being separately movable with respect to one another.

34. Apparatus according to claim 33, wherein said clamp members are smooth lock bars, and wherein said plate detent means is a smooth bent back end portion partially surroundingly engageable with respective ones of said smooth lock bars.

35. Apparatus according to claim 33, wherein said clamp members are pin lock bars having a plurality of protruding pin sections, and wherein said plate detent means includes a plurality of recesses in said plate for accommodating protrusions of said pin sections therethrough.

36. Apparatus according to claim 33, further comprising tool means selectively engageable in recess means of said clamp members for forcibly moving respective ones of said clamp members toward said non-clamping position to accommodate engagement of said plate detent means with said clamp members.

37. Apparatus according to claim 36, wherein said recess means extends substantially radially of said press cylinder when said clamping assembly is in an in-use position, and wherein said recess means are disposed intermediate the axial ends of said clamp members.

38. Apparatus according to claim 37, wherein said recess means are disposed axially in the middle of said clamp members.

39. Apparatus according to claim 38, wherein said clamp members are each constructed as single rigid members constituting a lock bar which extends substantially across the entire width of a printing plate being clamped thereby.

40. Apparatus according to claim 33, wherein said clamping assembly includes alignment clip means engageable with detent means of a second plate edge of said plate opposite said first-mentioned plate edge for aligning said second plate edge in the lateral direction.

41. Apparatus according to claim 40, wherein said base member includes groove means at the bottom thereof for guidably positioning said alignment clip means.

42. Apparatus according to claim 33, wherein said clamp members are flat metal bars in the form of lock bars having protrusions thereon for engaging in said plate detent means.

43. Apparatus according to claim 33, wherein clamping assembly attaching means including threaded members insertable through slots in said base member are provided, said slots being longer than the diameter of said threaded member to accommodate adjustment of the position of said base member on said press cylinder.

44. Apparatus according to claim 33, wherein said clamping assembly includes:

bearing means separate from said base member and said hinge pin means for attaching said clamp member means to said hinge pin means, and spiral spring means surrounding said hinge pin means and bearing against said clamp member means.

45. Apparatus according to claim 33, wherein said clamp members are symmetrically constructed to selectively clamp said first-mentioned plate edge with said printing plate extending in respective opposite circumferential directions of said press cylinder, whereby the circumferential direction of the printing plate can be readily reversed to accommodate reversal of the direction of rotation of the press cylinder without requiring removal of the clamping assembly from the press cylinder.

46. Apparatus according to claim 33, wherein said press cylinder means includes facing edge portions which define a gap therebetween for accommodating said base member and clamp member means, said facing edge portions being engageable with one edge of said printing plate when it is being clamped by engagement at an opposite edge by one of said clamp members, and wherein rigid detent pins are provided which extend from said facing edge portions for engagement through apertures in said printing plate to aid in anchoring said printing plate.

47. Apparatus for detachably holding thin flexible printing plates in position on a cylindrically shaped press cylinder comprising:

a clamping assembly for releasably clamping a first plate edge portion of said printing plate to said press cylinder with said printing plate engaged against an outwardly facing plate supporting surface at the press cylinder, and clamping assembly attaching means for detachably attaching said clamping assembly to said press cylinder, said clamping assembly and clamping assembly attaching means being dimensioned and configured such that they fit completely within a gap at said press cylinder having a radial height corresponding to the difference in thickness of the thin flexible printing plate and earlier used lead stereotype plates; whereby said clamping assembly can be attached directly to the outer cylindrical surface of a press cylinder having shim means without requiring additional groove means at the press cylinder or can be attached directly to a press cylinder in a groove of the press cylinder, which groove has a radial dimension corresponding to the thickness of such shim means, wherein said clamping assembly includes:

a base member detachably attachable to said press cylinder, hinge pin means supported at said base member, clamp member means attached to said hinge pin means for pivotal movement about a hinge pin axis between a clamping position with said clamping member means clampingly engaged in plate detent means of said first plate edge portion and a non-clamping position out of engagement with said plate detent means, and resilient means for continuously resiliently rotationally biasing said clamp member means towards said clamping position, wherein said hinge pin means is constructed as a single hinge pin for supporting two clamp member means which are clampingly pivotal in respective opposite directions to facilitate reversal of the circumferential direction of the printing plate being clamped, and wherein a single set of spiral spring means surrounding said hinge pin serves to resiliently bias both of said clamp member means towards their respective clamping positions.

48. Apparatus according to claim 47, wherein said clamping assembly attaching means includes means for attaching said clamping assembly to said press cylinder separately from and at a circumferential spacing from facing edge portions of said plate supporting surface.

49. Apparatus according to claim 51, further comprising tool means selectively engageable in recess means of said clamp member means for forcibly moving said clamp member means toward said non-clamping position to accommodate engagement of said plate detent means with said clamp member means.

50. Apparatus according to claim 47, wherein said clamping assembly attaching means includes threaded members insertable through slots in said base member, said slots being longer than the diameter of said threaded member to accommodate adjustment of the position of said base member on said press cylinder.

51. Apparatus for detachably holding thin flexible printing plates in position on a cylindrically shaped press cylinder comprising:

a clamping assembly for releasably clamping a first plate edge portion of said printing plate to said press cylinder with said printing plate engaged against an outwardly facing plate supporting surface at the press cylinder, and clamping assembly attaching means for detachably attaching said clamping assembly to said press cylinder, said clamping assembly and clamping assembly attaching means being dimensioned and configured such that they fit completely with a gap at said press cylinder having a radial height corresponding to the difference in thickness of the thin flexible printing plate and earlier used lead stereotype plates; whereby said clamping assembly can be attached directly to the outer cylindrical surface of a press cylinder having shim means without requiring additional groove means at the press cylinder or can be attached directly to a press cylinder in a groove of the press cylinder, which groove has a radial dimension corresponding to the thickness of such shim means, wherein said clamping assembly includes:

a base member detachably attached to said press cylinder, hinge pin means supported at said base member, clamp member means attached to said hinge pin means for pivotal movement about a hinge pin axis between a clamping position with said clamp member means clampingly engaged in plate detent means of said first plate edge portion and a non-clamping position out of engagement with said plate detent means, and resilient means for continuously resiliently rotationally biasing said clamp member means towards said clamping position, and wherein said clamp assembly includes alignment clip means engageable with detent means of said second plate edge for aligning said second plate edge in the direction parallel to the rotational axis of the press cylinder, said alignment clip means being formed separately of said base member and clamp member means.

52. Apparatus according to claim 51, wherein said alignment clip means is clamped between said base member and the circumference of said press cylinder.

53. Apparatus according to claim 52, wherein said alignment clip means includes respective opposite ends resiliently engaged against the respective facing edge portions of the shim means.

54. Apparatus according to claim 52, wherein said base member includes groove means at the bottom thereof for guidably positioning said alignment clip means.

55. Apparatus for releasably clamping a plate edge portion of a thin flexible printing plate to press cylinder means with said printing plate supported in an in-use printing position on a circumferential surface of said press cylinder means; said apparatus including:

a base member attachable to a radially outwardly facing surface of a press cylinder, hinge pin means supported at said base member, clamp member means attached to said hinge pin means for pivotal movement about a hinge pin axis between a clamping position with said clamp member means clampingly engaged in plate detent means of said plate edge portion and a non-clamping position out of engagement with said plate detent means, and resilient means for continuously resiliently rotationally biasing said clamp member means toward said clamping position, wherein said clamping assembly includes alignment clip means engageable with detent means of a second plate edge portion of said plate opposite said first-mentioned plate edge portion for aligning said second plate edge portion in the lateral direction, said alignment clip means being formed separately of said base member and clamp member means.

56. Apparatus according to claim 55, wherein said hinge pin means is constructed as a single hinge pin for supporting two clamp members which are clampingly pivotal in respective opposite directions to facilitate reversal of the circumferential direction of the printing plate being clamped.

57. Apparatus according to claim 55, wherein said hinge pin means is constructed as a pair of parallel hinge pins for supporting respective separate clamp member means which are clampingly pivotal in respective opposite directions to facilitate reversal of the circumferential direction of the printing plate being clamped.

58. Apparatus according to claim 55, wherein said base member includes groove means at the bottom thereof for guidably positioning said alignment clip means.

59. Apparatus according to claim 55, wherein said alignment clip means is configured to be clamped in position in between said base member and the radially outwardly facing surface of said press cylinder.

60. Apparatus according to claim 59, wherein said base member includes groove means at the bottom thereof for guidably positioning said alignment clip means.

61. Apparatus according to claim 59, wherein shim means are provided for radially supporting the printing plate on the press cylinder means, and wherein said alignment clip means includes respective opposite ends resiliently engaged against respective facing edge portions of the shim means, when in an in-use position.

62. Method of preparing an existing press cylinder designed for utilizing thick lead stereotype printing plates to be used with thin flexible printing plates; said method comprising:

attaching shim means directly to the outer cylindrical surface of said press cylinder, and detachably attaching a printing plate clamping assembly directly to the outer cylindrical surface of said press cylinder at a position intermediate facing edge portions of said shim means, said printing plate clamping assembly being separate from said shim means and dimensioned and configured such that said shim means and said printing plate clamping assembly can be attached to and detached from said press cylinder independently of one another.

63. Method according to claim 62, wherein said attaching of said shim means includes bolting said shim means directly to the outer cylindrical surface of said press cylinder.

64. Method according to claim 62, wherein said attaching of said printing plate clamping assembly includes bolting a base member of said printing plate clamping assembly directly to the outer cylindrical surface of said press cylinder.

65. Method according to claim 63, wherein said attaching of said printing plate clamping assembly includes bolting a base member of said printing plate clamping assembly directly to the outer cylindrical surface of said press cylinder.

66. Method according to claim 62, wherein said attaching of said printing plate clamping assembly includes clamping a resilient alignment clip means between a base member of said printing plate clamping assembly and said press cylinder, said alignment clip means being engageable with detent means of one plate edge portion of said printing plate when the other edge portion of said printing plate is clamped by said printing plate clamping assembly.

67. Method according to claim 66, wherein said alignment clip means includes respective opposite ends resiliently engaged against the respective facing edge portions of the shim means when said shim means and said clamping assembly are in an operative position.

68. Apparatus for releasably clamping a plate edge portion of a thin flexible printing plate to press cylinder means with said printing plate supported in an in-use printing position on a circumferential surface of said press cylinder means; said apparatus including:

a base member, hinge pin means carried by said base member, clamp member means pivotally movable about said hinge pin means, said clamp member means being directly engageable with said first plate edge portion when in a clamping position, resilient means for resiliently biasing said clamp member means towards its clamping position, tool means selectively engageable in recess means of said clamp member means for forcibly moving said clamp member means toward a non-clamping position to accommodate engagement of said plate detent means with said clamp member means, and aperture means in said base member for accommodating insertion of bolts therethrough to clamp said base member to the surface of said press cylinder, said bolts forming at least part of said clamping assembly attaching means, wherein said clamp member means and said aperture means are disposed such that said clamp member means covers said aperture means in the radial outward direction when in a clamping position, and wherein said aperture means are uncovered in the radial direction when said clamp member means is in an unclamping position, whereby attaching and detaching of said clamping assembly can be accommodated by movement of said clamp member means to the non-clamping position thereof.

* * * * *

UNITED STATES PATENT AND TRADEMARK OFFICE

CERTIFICATE OF CORRECTION

PATENT NO. : 4,191,106

DATED : March 4, 1980

INVENTOR(S) : Rudy Fermi et al.

It is certified that error appears in the above-identified patent and that said Letters Patent is hereby corrected as shown below:

In column 1, line 38, "cyliners" should be --cylinders--;
line 58 "will" should be --with--; and in
line 59, "saddler" should be --saddle--.

In column 6, line 26, "schemative" should be --schematic--.

In column 7, lines 37 and 38, "clamping by" should be --clampingly--;
line 47, "anchord" should be --anchored--.

In column 8, line 8, after "when", --in--should be added;
line 28, "opening" should be --openings--;
line 36, "engated" should be --engaged--; and in
line 46, "opening" should be --openings--.

In column 9, line 1, "an" should be --and--.

In column 10, line 37, second occurrence of "to" should be deleted;
line 61, "provide" should be --provided--; and in
line 65, "sich" should be --such--.

UNITED STATES PATENT AND TRADEMARK OFFICE

CERTIFICATE OF CORRECTION

PATENT NO. : 4,191,106

DATED : March 4, 1980

INVENTOR(S) : Rudy Fermi, John Pickard, Alex Kocsis, David Bratton Gerald Kasner It is certified that error appears in the above-identified patent and that said Letters Patent are hereby corrected as shown below:

In column 12, line 21, "portin" should be --portion--.

In column 14, line 2, "theaded" should be --threaded--; and in line 8, "wherein" should be --when in--.

In column 18, line 20, "51" should be --47--.

Signed and Sealed this

*Twenty-fourth* Day of *July 1984*

[SEAL]

*Attest:*

GERALD J. MOSSINGHOFF

*Attesting Officer*

*Commissioner of Patents and Trademarks*